US011234498B2

(12) United States Patent
Muenmai

(10) Patent No.: US 11,234,498 B2
(45) Date of Patent: Feb. 1, 2022

(54) JEWELRY CLIPS

(71) Applicant: PANDORA A/S, København V (DK)

(72) Inventor: Netima Muenmai, Samutprakarn (TH)

(73) Assignee: Pandora A/S, København V (DK)

( * ) Notice: Subject to any disclaimer, the term of this patent is extended or adjusted under 35 U.S.C. 154(b) by 0 days.

(21) Appl. No.: 16/561,409

(22) Filed: Sep. 5, 2019

(65) Prior Publication Data

US 2021/0068508 A1 Mar. 11, 2021

(51) Int. Cl.
*A44C 15/00* (2006.01)
*A44B 13/02* (2006.01)

(52) U.S. Cl.
CPC ..... *A44C 15/005* (2013.01); *A44B 13/02* (2013.01)

(58) Field of Classification Search
CPC ..... A44C 13/00; A44C 15/00; A44C 17/0208; A44C 25/00; A44C 25/007; A44C 13/02; A44C 5/18; A44C 15/005; A44C 2201/00; A44C 1/00; F16B 2/10
USPC ..... 63/21, 23, 29.1, 38
See application file for complete search history.

(56) References Cited

U.S. PATENT DOCUMENTS 1,240,043 A 9/1917 Gregory
2,937,459 A * 5/1960 Belfield ..... A44C 23/00 434/246
2,946,237 A 7/1960 Hebert
2,992,495 A * 7/1961 Perreira ..... A44C 23/00 434/246
3,105,501 A * 10/1963 Scotti ..... A45D 20/00 132/212
3,181,217 A 5/1965 Bohlinger
3,187,602 A 6/1965 Cousins
3,590,830 A 7/1971 Hannum
3,766,346 A 10/1973 Alexander
4,161,637 A 7/1979 Priesemuth
4,237,702 A 12/1980 Caverly
4,426,804 A 1/1984 Hutson
4,554,934 A * 11/1985 Mooneyhan ..... A45D 8/24 132/245
4,754,534 A 7/1988 Helwick
(Continued)

FOREIGN PATENT DOCUMENTS

CH 676073 B5 6/1991
CN 204969817 U 1/2016
(Continued)

*Primary Examiner* — Jack W Lavinder
(74) *Attorney, Agent, or Firm* — Avant Law Group, LLC

(57) ABSTRACT

A jewelry clip is provided for clipping onto an elongated member of a bracelet and/or necklace. The jewelry clip includes first and second parts connected by a hinge and being rotatable between open and closed states. The clip in the closed state is adapted for gripping the elongated member and in the open state is adapted for being released from the elongated member. At least one discrete spring biases the clip toward the closed state when the clip is in the open state. The clip has, in the closed state, a through hole. At least one of the first and second parts includes at least one resilient element defining at least part of an inner surface of the jewelry clip defining the through hole. When the clip is clipped onto the elongated member, the resilient element provides a frictional resistance against movement of the elongated member through the through hole.

19 Claims, 6 Drawing Sheets

(56) References Cited

U.S. PATENT DOCUMENTS

| | | | | |
|---|---|---|---|---|
| 4,924,562 | A | 5/1990 | Pogharian | |
| 5,082,011 | A | 1/1992 | Wu | |
| 5,085,060 | A | 2/1992 | Matsushita | |
| 5,396,912 | A | 3/1995 | Chou | |
| 5,477,870 | A | 12/1995 | Menaged | |
| 5,687,585 | A | 11/1997 | Ferrell | |
| 5,996,593 | A | 12/1999 | Horman | |
| 6,145,171 | A | 11/2000 | Hoshino | |
| 6,311,699 | B1 | 11/2001 | Horman | |
| 6,439,242 | B1 | 8/2002 | Head | |
| 6,484,376 | B1 | 11/2002 | Khatchadourian | |
| 6,508,080 | B1 | 1/2003 | Ninomiya | |
| 6,557,376 | B2 | 5/2003 | Pratt | |
| 6,901,771 | B2 | 6/2005 | Ooide | |
| 7,007,507 | B2 | 3/2006 | Enevoldsen | |
| 7,082,651 | B2 | 8/2006 | Ninomiya | |
| 7,322,076 | B2 | 1/2008 | Ninomiya | |
| 7,513,774 | B2 * | 4/2009 | Krilich | A44C 23/00 434/246 |
| 7,540,172 | B2 | 6/2009 | Julkowski | |
| 7,805,881 | B2 | 10/2010 | Kavanuagh | |
| 7,878,023 | B2 | 2/2011 | Bak | |
| 8,105,088 | B2 | 1/2012 | Charles | |
| 8,950,214 | B2 | 2/2015 | Gray et al. | |
| 8,973,399 | B2 | 3/2015 | Heiden | |
| 9,173,459 | B2 * | 11/2015 | Gisser | A44C 5/2095 |
| 9,302,074 | B2 | 4/2016 | Atkinson | |
| 9,326,569 | B1 | 5/2016 | Cipolla | |
| 9,492,638 | B2 * | 11/2016 | McKinnis | A61B 8/12 |
| 9,743,725 | B2 | 8/2017 | Hines | |
| 9,839,266 | B2 | 12/2017 | Gray et al. | |
| 10,702,026 | B2 * | 7/2020 | Gray | A44C 1/00 |
| 2009/0141866 | A1 | 6/2009 | Fenske | |
| 2014/0182332 | A1 | 7/2014 | Gray | |
| 2014/0223962 | A1 | 8/2014 | Gray et al. | |
| 2014/0230488 | A1 | 8/2014 | Gray et al. | |
| 2015/0114039 | A1 | 4/2015 | Gray et al. | |
| 2015/0164190 | A1 | 6/2015 | Zaritsky | |
| 2016/0166020 | A1 | 6/2016 | Rohde | |
| 2018/0213892 | A1 | 8/2018 | Gray et al. | |
| 2018/0213893 | A1 | 8/2018 | Gray et al. | |
| 2018/0360174 | A1 * | 12/2018 | Rohde | A44C 25/004 |
| 2021/0045501 | A1 | 2/2021 | Muenmai | |

FOREIGN PATENT DOCUMENTS

| | | | |
|---|---|---|---|
| CN | 205390592 | U | 7/2016 |
| DE | 202014001624 | U1 | 5/2015 |
| FR | 1566678 | A | 5/1969 |
| GB | 2170682 | A | 8/1986 |
| JP | H03284216 | A | 12/1991 |
| JP | H09182609 | A | 7/1997 |
| JP | 2003230413 | A | 8/2003 |
| JP | 2005230461 | A | 9/2005 |
| JP | 2005230462 | A | 9/2005 |
| JP | 5151912 | B2 | 5/2013 |
| KR | 101426023 | B1 | 8/2014 |
| WO | 0139627 | A1 | 6/2001 |
| WO | 0232249 | A2 | 4/2002 |
| WO | 2005009166 | A2 | 2/2005 |
| WO | 2006125155 | A1 | 11/2006 |
| WO | 2010037183 | A1 | 4/2010 |
| WO | 2014121797 | A1 | 8/2014 |
| WO | 2014121798 | A1 | 8/2014 |
| WO | 2015128074 | A1 | 9/2015 |
| WO | 2016034182 | A1 | 3/2016 |
| WO | 16069565 | A1 | 5/2016 |
| WO | 2017013066 | A1 | 1/2017 |
| WO | 2017013067 | A1 | 1/2017 |
| WO | 2019214792 | A1 | 11/2019 |

* cited by examiner

JEWELRY CLIPS

FIELD

The present disclosure relates to a jewelry clip for a bracelet and/or a necklace, to a set of parts for being assembled to form a bracelet or necklace comprising a jewelry clip, and to a method for assembling such a set of parts.

BACKGROUND

Jewelry, such as necklaces and bracelets of the prior art, often consists of a plurality of freely movable ornamental components, e.g. beads or charms strung on an elongated member, e.g. a chain, wire, such as a braided wire, or string. To prevent the freely movable beads from grouping together at the bottom of the elongated member or to group the freely movable beads in certain areas of the elongated member, an ornamental component provided with a stopping mechanism configured to grip the necklace or bracelet may be used. The ornamental component can be fixed or attached to the elongated member in one or more positions along the elongated member and has such dimensions that the freely movable beads are not able to move past the component. A variety of such ornamental components have been suggested in the prior art.

Resilient materials such as silicone are commonly used for stopping mechanisms. The resilient material deforms when it comes into contact with a bracelet/necklace resulting in a spring force (attempting to restore the original shape of the silicone) that will releasably secure the ornamental component to a selected position of the bracelet/necklace.

The applicant's WO 2017/013066 and WO 2017/013067 disclose jewelry clips with such a resilient element which allows the jewelry clip to fit securely onto selected positions of an elongated member of a bracelet and/or necklace. To retain the resilient element, the jewelry clips are provided with a cavity in the through hole, wherein an anchor portion of the resilient element has dimensions larger than the opening of the cavity so that it is retained when subjected to forces in an axial direction, i.e. the longitudinal direction of the elongated member.

Some jewelry clips of the prior art comprising resilient elements have a tendency to fall off the elongated member onto which they are clipped.

SUMMARY

A first aspect of this disclosure provides a jewelry clip for being clipped onto an elongated member of a bracelet and/or necklace. The jewelry clip has a first part and a second part connected by a hinge, with the first and second parts being moveable between an open state and a closed state by rotation about a hinge axis of the hinge. The jewelry clip in the closed state is adapted for gripping the elongated member and in the open state is adapted for being released from the elongated member. The jewelry clip has, in the closed state, a through hole extending in a longitudinal direction between a first and a second opening so that the elongated member can be positioned to extend through the through hole. The jewelry clip further has at least one discrete compression or torsion spring, with the spring in the open state biasing the jewelry clip toward the closed state. At least one of the second and first parts includes at least one resilient element positioned to form part of the at least one of the first and second parts so that the resilient element defines at least part of an inner surface of the jewelry clip defining the through hole in the closed state of the jewelry clip. When the jewelry clip is clipped onto the elongated member, the resilient element can provide a frictional resistance against movement of the elongated member through the through hole.

Springs used in prior art jewelry clip type components typically act to bias the jewelry toward an open state such as in lockets or locks released by button-press. However, using a spring to bias the jewelry toward a closed state can provide advantages such as will be made clear in the following.

By providing a jewelry clip according to this disclosure, wherein the jewelry clip in the open state is biased toward the closed state by a discrete spring, the jewelry clip may be prevented from opening whereby an improved retention on an elongated member may be achieved. In other words, the discrete spring provides the jewelry clip with a clamping force biasing the jewelry clip toward the closed state, improving the ability of the jewelry clip to remain closed, as a force (the clamping force provided by the discrete spring) has to be overcome before the jewelry clip can be opened.

The jewelry clip being biased toward the closed state may also improve the ease of handling and closing of the jewelry clip.

The "discrete spring" may simply be referred to as "spring" in this disclosure.

The spring biasing the jewelry clip toward the closed state may further improve the retention of the jewelry clip on the bracelet/necklace, as jewelry clips tend to have a certain amount of play in a locked state, which the spring can act to negate by biasing the jewelry clip parts toward each other—thus minimizing play and increasing the force with which the jewelry clip grips the bracelet or necklace (i.e. increasing the retention force of the jewelry clip against movement along the longitudinal direction of the resilient element or the bracelet/necklace). This may become of particular advantage when a resilient element has been worn due to age or use.

The jewelry clip may be configured so that the surface of the elongated member can be gripped by the at least one resilient element and allow the jewelry clip to be releasably secured at selected positions along the elongated member. Thus, a jewelry clip which can be arranged at a selected position on a necklace and/or bracelet is provided.

The jewelry clip may be movable by opening it and repositioning it at another selected position or by a user applying a force exerted in the longitudinal direction on the jewelry clip, whereby the jewelry clip in the closed state can be moved along the elongated member.

A "clip", or "jewelry clip", in the context of this disclosure may be defined as any component that can be clipped onto a bracelet and/or necklace for ornamental purposes. A jewelry clip may comprise ornamentation, specifically at or on or as part of a surface thereof, for facing the environment when the jewelry clip is worn by a user. Such ornamentation may be in the form of spatial ornamentation, e.g. including projections or patterns in a surface.

A jewelry clip according to the first aspect of this disclosure may be used to organize freely movable beads on a bracelet or necklace. For example, two jewelry clips may be arranged at desired positions on an elongated member of a bracelet or necklace, whereby they resiliently grip the elongated member. Consequently, the bracelet or necklace may be divided into three distinct zones for freely movable beads. This may be used to prevent the freely movable beads from grouping together.

It should be noted that in the context of this specification the term "bracelet" is not exclusive to jewelry articles for being worn on the wrists, but is also intended to cover, for example, ankle bracelets, sometimes referred to as anklets.

In the context of the present specification, the term "resilient" is to be understood as being able to at least partly recoil or spring back into shape after bending, stretching, or being compressed.

In the context of the present specification, the term "discrete" is to be understood as individually separate and distinct (i.e. not being formed integrally with something else).

The at least one resilient element may be an element that is deformable under the influence of a particular force and capable of recoiling back into substantially its original shape once the particular force is removed.

The at least one resilient element may be made of a resilient material such as a silicone material (including a silicone rubber). Preferably, the at least one resilient element is manufactured from a material comprising at least 50, more preferred at least 80, more preferred at least 95 percent of, most preferred essentially consists of, a material or a combination of materials selected from the group consisting of silicone, silicone rubber, natural rubber, synthetic rubber, PTFE, polyethylene, polypropylene, HDPE, polystyrene and nylon. The resilient element may comprise additives and fillers, including coloring agents.

The at least one resilient element forming part of the first or second part may be spaced apart from the other of the jewelry clip parts than the one it forms part of in a relaxed/uncompressed state and in a compressed state when the jewelry clip is arranged on an elongated member. In the context of the present specification, the term "spaced apart" is to be understood as being separated, having space between, and/or not being in direct contact.

The at least one resilient element may be secured to the first or second part by any appropriate means such as by an adhesive and/or by gripping means of the first or second part.

The at least one resilient element may be retained by a retaining element. This may prevent the at least one resilient element from bending away from the first or second part of the jewelry clip on which it is positioned and into the through hole when subjected to frictional forces by the elongated member in the longitudinal direction. This may facilitate the resilient element remaining secured to the first or second part of the jewelry clip.

In an embodiment, at least one of the at least one resilient element is retained by at least one retaining element. In an embodiment, two or more resilient elements are retained by at least one retaining element. In an embodiment, each resilient element is retained by a retaining element.

The at least one resilient element may have a first projection and a second projection, with each of the projections comprising a gripping surface adapted to engage the surface of the elongated member in the closed state of the jewelry clip. The gripping surfaces partly define the through hole.

The first and second parts of the jewelry clip may provide the primary structural strength of the jewelry clip. The jewelry clip may be made, for example, of metal, glass, wood, plastic, ceramics, or a combination thereof. The first and second parts of the jewelry clip may be individually integrally molded (i.e., made from a single mold). The jewelry clip may have any outer shape, such as round or rectangular, and/or may be provided with ornamentation.

The through hole may further be partly defined by two side walls provided by the first and/or second parts.

The first part may have a surface defining a first inner surface part of the through hole of the jewelry clip, and the second part may have a surface defining a second inner surface part of the through hole opposite of the first surface. The first and second inner surface parts may at least partly define the through hole.

In some embodiments, the first and/or second part comprises a cavity having an opening in the first or second inner surface parts respectively, wherein the first resilient element comprises an anchor portion positioned inside the cavity. Where the at least one resilient element has first and second projections, the first and second projections may protrude from the anchor portion through the opening in the first or second inner surface parts, wherein the dimensions of the anchor portion are greater than the dimensions of the opening in the first or second inner surface parts so that the cavity is configured to secure the at least one resilient element in the first or second part.

Consequently, the at least one resilient element may be secured to the first or second part in an easy and secure manner. This further allows the at least one resilient element to be secured to the first or second part without the use of an adhesive, thereby protecting the user from coming into contact with potential harmful chemicals and enabling simpler assembly. In some embodiments, the cavity is shaped so as to grip the at least one resilient element and secure it in the first or second part.

During manufacture of the jewelry clip, the anchor portion of the at least one resilient element may thus be readily arranged in the cavity using the resilience of the material to compress it to fit through the opening of the cavity. When inserted into the cavity, the at least one resilient element may again expand to fit into the cavity and be secured therein. Following the insertion of the at least one resilient element into the cavity, the retaining element may be arranged between the first and second projections to ensure that the at least one resilient element will not fall out of the cavity during use.

In some embodiments, the first surface on the first and/or second part has a shape that substantially corresponds to a shape of the surface of the elongated member of the bracelet/necklace. As such, the at least one resilient element and/or the gripping surfaces thereof may fit snugly around the elongated member.

In some embodiments, the first surface is convex in the longitudinal direction and/or is provided with rounded edges toward the first and second openings. An advantage of this may be that wear, caused by the user forcefully moving the jewelry clip along the elongated member, is reduced or at least limited to a central region, i.e. in the longitudinal direction, of the first surface, thereby maintaining the structural integrity and visual appearance of the first surface near the first and second openings, where the surface may be visible to the user when the jewelry clip is clipped onto the elongated member.

In some embodiments, the first surface is arced in a width direction perpendicular to the longitudinal direction. An advantage of this is that wear on the first surface, caused by the user forcefully moving the jewelry clip along the elongated member, may be limited to the peripheral edges, i.e. in the width direction, thereby maintaining the structural integrity of the first surface near the longitudinal center axis, thus prolonging the lifespan of the jewelry clip.

In some embodiments, the gripping surfaces are convex in the longitudinal direction and/or are rounded at the edges in the longitudinal direction. An advantage of providing the gripping surfaces with rounded edges (instead of sharp edges) may be that the wear on the edge, caused by the user forcefully moving the jewelry clip along the elongated member, may be reduced—thus prolonging the lifespan of the resilient element.

In an embodiment, a length of the at least one resilient element, i.e. in the longitudinal direction, is one half or less, preferably one third or less, of a length of the through hole. This may achieve a greater structural integrity of the jewelry clip parts including the at least one resilient element, as the size of the cavity can be reduced, whereby less material will have to be removed/left out. Furthermore, this may reduce the manufacturing costs of the jewelry clip and will allow the at least one resilient element to be spaced apart from the peripheral edges, i.e. the edges at the first and second openings, thereby increasing the aesthetic experience for the user.

The jewelry clip may comprise at least one, two, three, four, five, or six discrete compression or torsion springs.

The spring may be a helical spring. This may be in the form of a closed, ground, double closed, or open helical spring. "Helical spring" may also be denoted "coil spring". Additionally or alternatively, the spring may be a helical torsion spring, a leaf spring, a volute spring, a gas spring, or any other suitable spring.

Additionally or alternatively, the discrete spring biases the jewelry clip toward the closed state anywhere between a fully open state and the closed state. In this way, there is always a force acting to urge the jewelry clip toward the closed state, further improving the retention of the jewelry clip and preventing it from accidental opening. It may also further improve the handling and closing of the jewelry clip. The "fully open state" may be understood as a state in which the jewelry clip is not able to open any further. The term "anywhere" in this context may be understood as any position of the two jewelry clip parts between the fully open state and the closed state of the jewelry clip.

Additionally or alternatively, at least one of the at least one resilient element is configured to be compressed when the jewelry clip is in the closed state and clipped onto the elongated member. This may provide an improved grip between the jewelry clip and the elongated member and increase the frictional resistance against movement and improving how securely the jewelry clip is retained in the longitudinal direction on the elongated member.

However, the compression of the resilient element may also provide a force urging the jewelry clip to open. The force provided by the spring biasing the jewelry clip toward the closed state may counteract this force and thus provide a more secure jewelry clip.

A similar force urging the jewelry clip to open may also occur when the jewelry clip is attached on, and compresses, a resilient elongated member. In such situations the force urging the jewelry clip to open provided by the compression of the resilient element and the compression of the resilient elongated member may compound, making the counteracting force provided by the spring even more important.

Additionally or alternatively, the jewelry clip is configured to be positionally fixed by the frictional resistance of the resilient element on the elongated member when clipped onto the elongated member, and to be moved along the elongated member by providing a force that overcomes the frictional resistance. This may allow the jewelry clip to be moved along and fixed at a desired position along the elongated member. This may allow the jewelry clip to be used to organize beads or other ornamental components on a necklace or bracelet and potentially fix them in place at desired positions along the necklace or bracelet. "Positionally fixed" may be understood as being secured on the elongated member such that the relative position of the jewelry clip and the elongated member is maintained.

Additionally or alternatively, the frictional resistance may be overcome by a force exerted by a user's hand. Hereby, the jewelry clip may be moveable along the elongated member by hand.

Additionally or alternatively, the jewelry clip in the closed state is locked by a snap lock. This may have the advantage that the jewelry clip becomes more secure as it is further retained in the closed state by further mechanical engagement. Such a snap lock may utilize mechanical engagement so that, to bring the jewelry clip from the closed state to the open state, a certain magnitude of force has to be overcome to unlock the snap lock, when pulling or pushing the first clip part and the second clip part apart.

The snap lock may comprise two or more mechanical elements which engage with each other in the closed state of the jewelry clip and, so, result in a locking effect, which locks the jewelry clip. To bring the mechanical elements out of engagement and unlock the jewelry clip, a certain force has to be overcome. This may provide a jewelry clip that is more secure.

The spring biasing the jewelry clip toward the closed state may provide a further magnitude of force that has to be overcome when opening the jewelry clip. This may be adjusted by using different types of springs, materials, spring constants, shapes etc. which may be tailored to the given application.

The spring biasing the jewelry clip toward the closed state may be further advantageous even when the locking mechanism (snap etc.) does not open, as, as mentioned above, the biasing force provided by the spring will act to negate play, including play that may exist in the snap lock. This may be particularly useful if the lock of the jewelry clip becomes worn and slightly more loose such that there is more play in the closed state.

Similarly, the spring may also be advantageous for lock types that are activated via a button mechanism.

Additionally or alternatively, the snap lock may be positioned on a portion of the jewelry clip that is opposite the hinge axis.

Additionally or alternatively, the snap lock is positioned on a portion of the jewelry clip that is remote from the hinge axis.

Additionally or alternatively, the snap lock may be positioned near the hinge axis.

Additionally or alternatively, the snap lock may be positioned in the hinge.

Additionally or alternatively, the snap lock may form part of the hinge.

Additionally or alternatively, the discrete spring comprises a first end and a second end, where the first end is in physical contact with the first clip part and the second end is in physical contact with the second clip part, to thereby bias the jewelry clip toward the closed state. This allows the spring to bias the hinged first and second parts of the jewelry clip toward the closed state.

Additionally or alternatively, the first or second end of the spring may be arranged in a first spring cavity in the first clip part.

Additionally or alternatively, the first or second end of the spring may be arranged in a second spring cavity in the second clip part.

Additionally or alternatively, the first or second end of the spring may abut the first clip part. Additionally or alternatively, the first or second end of the spring may abut the second clip part.

The spring may be secured to the first and/or second part by any means such as by an adhesive or by gripping means in the first and/or second part.

Additionally or alternatively, the discrete spring is located at the hinge axis. This may allow a standard compression spring to be used to bias the jewelry clip toward the closed state. This may reduce the cost of manufacturing.

Additionally or alternatively, the discrete spring is positioned concentrically with the hinge axis. This may provide a more compact clip as a spring such as a helical torsion spring may be arranged concentrically with the hinge axis, thus optimizing the use of available space within the jewelry clip.

Additionally or alternatively, the spring may be a helical compression spring positioned at the hinge axis, with a first end of the spring arranged in a first spring cavity in the first clip part and the second end of the spring arranged in a second spring cavity in the second clip part, so as to bias the jewelry clip toward the closed state.

Additionally or alternatively, the spring may be a helical torsion spring arranged concentrically with the hinge axis, where the helical torsion spring has a first end which abuts the first clip part and a second end which abuts the second clip part, so as to bias the jewelry clip toward the closed state.

Two or more of the embodiments of jewelry clips above may be combined to form other embodiments of jewelry clips.

A second aspect of this disclosure relates to a set of parts for being assembled to form a bracelet or necklace having an elongated member for a bracelet or a necklace and a jewelry clip according to any one of the previous embodiments.

The jewelry clip of the set of parts according to the second aspect may be according to any one of the above embodiments of jewelry clips.

Providing a set of parts for being assembled to form a bracelet or necklace, where the jewelry clip is biased toward the closed state and the jewelry clip comprises at least one resilient element that can provide a frictional resistance against movement of the elongated member through the through hole, may have the advantage of providing a bracelet or necklace that allows for organization of beads or other types of ornamental components on the bracelet or necklace whilst providing a more secure clip.

Additionally or alternatively, the elongated member may be a resilient elongated member.

As mentioned above, when the elongated member is a resilient elongated member, this may provide an increased force urging the jewelry clip to open as a result of both the resilient elongated member and the at least one resilient element being compressed. This makes the counteracting force provided by the spring biasing the jewelry clip toward the closed state, even more important.

A third aspect of this disclosure relates to a method for assembling a set of parts according to one or more of the previous embodiments of sets of parts to form a necklace or bracelet by clipping a jewelry clip onto an elongated member. The method includes the step of clipping the jewelry clip onto the elongated member. This may provide the advantage of an easy to assemble necklace or bracelet. It may provide the further advantage of a necklace or bracelet allowing organization of beads or other ornamental components on the necklace or bracelet. A further advantage may be that the assembly and organization may be performed without need for any tools or other special utensils.

Additionally or alternatively, the step of clipping the jewelry clip onto the elongated member may include the steps of: (a) bringing the jewelry clip into an open state by overcoming a force biasing the jewelry clip toward a closed state provided by a discrete spring, by rotating the first and the second clip part about a hinge axis of a hinge connecting the first and second parts; and (b) bringing the jewelry clip from the open state into the closed state thereby enclosing the elongated member such that the elongated member is positioned in the through hole of the jewelry clip where the jewelry clip grips the elongated member.

The jewelry clip of the set of parts according to the method of the third aspect may be according to any one of the above embodiments of sets of parts. The jewelry clip of the set of parts of the method according to the third aspect may similarly be according to any one of the above embodiments of jewelry clips.

A person skilled in the art will appreciate that any one or more of the above aspects of this disclosure and embodiments thereof may be combined with any one or more of the other aspects of this disclosure and embodiments thereof.

BRIEF DESCRIPTION OF THE DRAWINGS

The aspects of this disclosure will now be described in greater detail based on non-limiting exemplary embodiments and with reference to the drawings, in which.

DETAILED DESCRIPTION

In the following, embodiments of the jewelry clips will be described in further detail. Each specific variation of the features can be applied to other embodiments of unless specifically stated otherwise. Note that for illustrative purposes the dimensions, especially thicknesses, of the different elements shown may be exaggerated.

Figure 1:
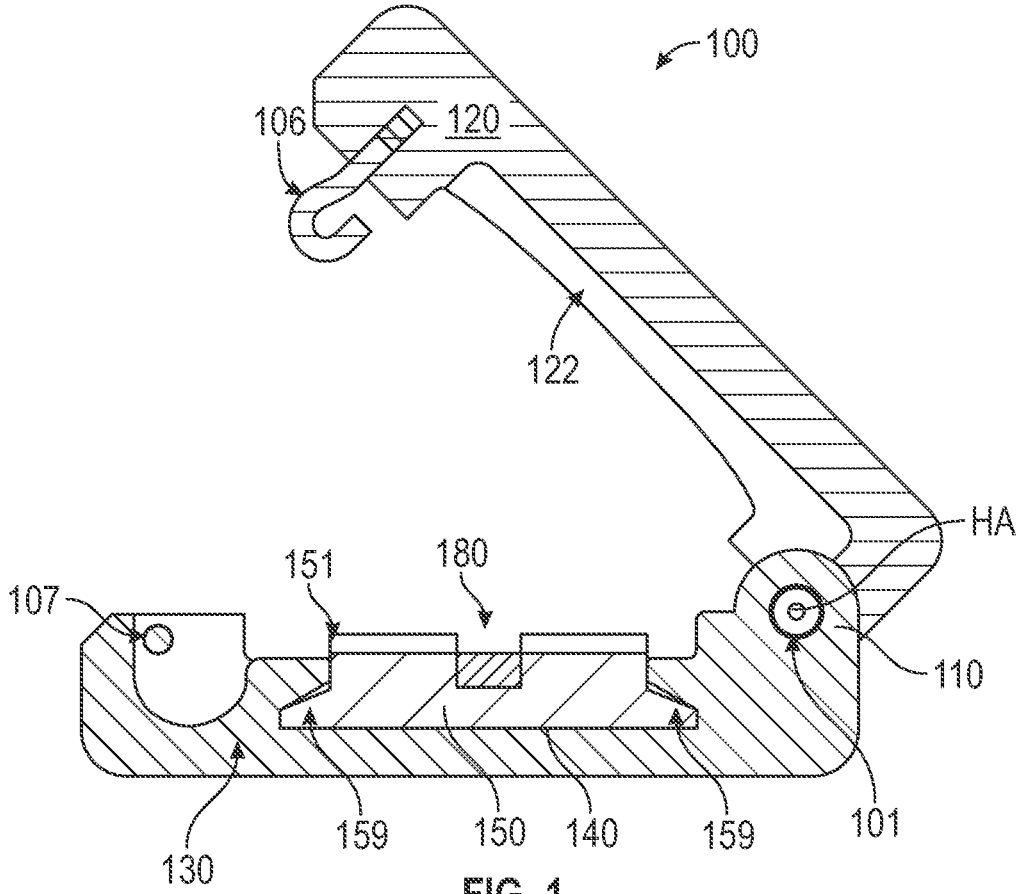
FIG. 1 shows a schematic side cross section view of a jewelry clip in the open state.
Figure 2:
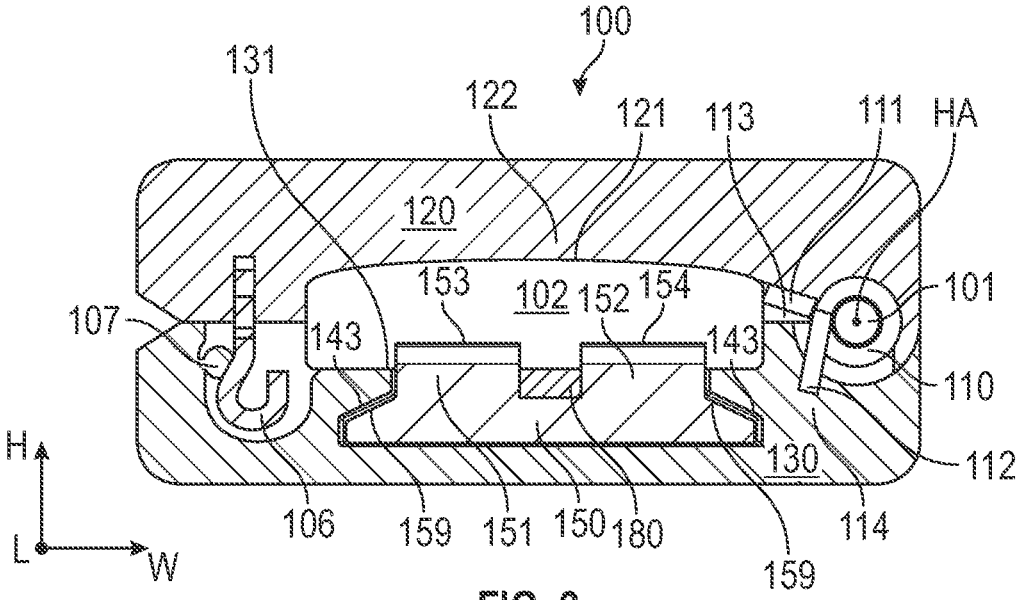
FIG. 2 shows a schematic side cross section of the jewelry clip of FIG. 1 in the closed state.

Turning first to FIGS. 1 and 2, which show side cross section views of a first embodiment of a jewelry clip in an open and closed state, respectively. The jewelry clip 100 is a jewelry clip with a rectangular outer shape in cross section. The jewelry clip 100 comprises a first part 120, i.e. a first half shell, and a second part 130, i.e. a second half shell, which are connected by a hinge 101 allowing the jewelry clip 100 to be moved between the open state, shown in FIG. 1, and the closed state, shown in FIG. 2, by rotation of the first and second clip parts 120, 130 about the hinge axis HA.

A discrete spring 110, in this case a helical torsion spring positioned concentrically with the hinge axis HA, biases the jewelry clip 100 toward the closed state. This is achieved by a first end 111 of the spring 110 being arranged in a first spring cavity 113 in the first clip part 120 and a second end 112 of the spring being arranged in a second spring cavity 114 in the second clip part 130, where each spring end 111, 112 exerts a force on the first and second clip parts 120, 130, respectively, urging the jewelry clip parts to rotate about the hinge axis HA toward the closed state of the jewelry clip 100. This may also be achieved by a compression spring, such as a helical compression spring positioned at the hinge axis HA and arranged between the two clip parts 120, 130 where a respective end of the compression spring is in physical contact with and exerts a force on a respective clip part 120, 130, urging the two clip parts 120, 130 to rotate about the hinge axis HA toward the closed state of the jewelry clip 100, as described above. The inclusion of a discrete spring 110 thus improves handling and closing of the jewelry clip 100 and improves the retention of the jewelry clip 100 on an elongated member of a bracelet or necklace as the force provided by the spring 110 biasing the jewelry clip toward the closed state both provides a force acting to keep the jewelry clip closed as well as increasing the force with which the jewelry clip grips the elongated member. The force provided by the spring will also act to negate play that may inherently exist in the jewelry clip or that may arise due to wear and tear, and may in this way improve the performance and lifespan of the jewelry clip.

In some embodiments, the spring 11 biases the jewelry clip toward the closed state anywhere between a fully open state and the closed state. In this way a force biasing the jewelry clip 100 toward the closed state is provided at any position of the jewelry clip parts 120, 130.

To enable the jewelry clip 100 to be locked in the closed state, the jewelry clip comprises a snap lock mechanism 106, 107. In the shown embodiment, the snap lock mechanism 106, 107 comprises a locking spring 106 and a locking spring contact point 107, the locking spring 106 engaging the locking spring contact point 106 when the jewelry clip is closed, whereby the mutual mechanical engagement between the two 106, 107 provides a locking effect. To bring the jewelry clip from the closed state to the open state, a certain magnitude of force has to be overcome to unlock the snap lock mechanism and bring the locking spring 106 out of locking engagement with the locking contact point 106, when pulling or pushing the first clip part and the second clip part apart. This provides additional security to ensure the jewelry clip does not unintentionally open.

In the closed state, shown in FIG. 2, the jewelry clip 100 has a through hole 102 allowing the jewelry clip 100 to be clipped onto the elongated member. The through hole 102 extends in a longitudinal direction (L) between a first and a second opening 115, 116 (best seen in FIG. 9). In this embodiment the through hole 102 and the jewelry clip 100 have a substantially rectangular cross-sectional shape in the longitudinal direction. The through hole 102 is partly defined by a first substantially flat surface 121 of the first part 120 and a second substantially flat surface 131 of the second part 130. The through hole 102 is further partly defined by two side walls formed on the first and second parts 120, 130. In the open state, the through hole 102 is open at the side opposite the hinge 101, whereby the jewelry clip 100 can be placed onto or removed from the elongated member. The first surface 121 is adapted for gripping a surface of the elongated member.

The jewelry clip 100 further comprises a resilient element 150 positioned in the second part 130 to form part of the second part so that the resilient element forms at least part of an inner surface of the jewelry clip defining the through hole 102 in the closed state of the jewelry clip. The resilient element 150 can provide a frictional resistance against movement of the elongated member through the through hole 102, between the jewelry clip 100 and the surface of the elongated member to allow the jewelry clip 100 to be releasably secured at selected positions along the elongated member, i.e. the resilient element 150 and the rigid gripping surfaces 121 grips opposite surfaces of the elongated member, thereby securing the jewelry clip 100 at the selected position of the elongated member. In this way the jewelry clip 100 may be positionally fixed by the frictional resistance on the elongated member when clipped on the elongated member, but can be moved along the elongated member by providing a force that overcomes the frictional resistance.

In the shown embodiment, the first surface 121 is provided with a small curvature in the width direction (W). This curvature limits wear caused by friction between the elongated member and the first surface 121 to the outer regions, i.e. outer edges in the width direction. Furthermore, the edges 122 of the first surface 121 toward the first and/or second openings are rounded so as to limit wear at the edges 122, where the first surface might be visible to the user.

The jewelry clip 100 may be forced to move along the elongated member, on which it is positioned by exerting a force in the longitudinal direction (L), preferably using a hand. Thereby the jewelry clip 100, in the closed state, can be moved along the elongated member. The resilient element 150 shown here has an oblong cross-sectional shape in the longitudinal direction (L) with the width, i.e. in a width direction (W) perpendicular to the longitudinal direction (L), of the resilient element 150 being at least twice that of the height, i.e. in a height direction (H) perpendicular to the longitudinal direction (L) and the width direction (W), of the resilient element 150. Resilient elements with other shapes, geometries and dimensions may be used as required by the application or availability of space within the jewelry clip.

To secure the resilient element 150 in the second part 130, the second part 130 comprises a cavity 140 extending into the second surface 131 and having an opening in the second surface 131. The cavity 140 is formed with side walls 143 with overhang, such that the opening has a smaller area than the base of the cavity 140. The cavity 140 is thus able to retain the resilient 150 as the overhanging sidewalls 143 make it difficult for the resilient element 143 to fall out of the cavity.

However, due to the oblong cross-sectional shape and the resilience of the resilient element 150, the resilient element 150 may be bent and/or compressed so that it can be inserted, as is done during assembly, or removed from the cavity 140. To prevent the resilient element 150 from unintentionally being removed from the cavity 140, the jewelry clip 100 comprises a retaining element 180 extending in the longitudinal direction (L) over the opening of the cavity 140 and over the resilient element 150, so that the resilient element 150 is securely retained in the cavity 140. In the shown embodiment, the retaining element 180 is formed by a tab extending over the resilient element 150.

Figure 4:
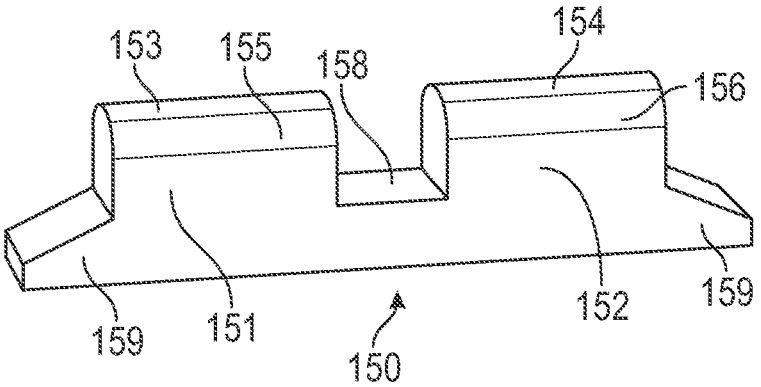
FIG. 4 shows a perspective side view of a resilient element of the jewelry clip of FIG. 1.

The resilient element 150 comprises a first and a second projection 151, 152 which protrude beyond the second surface 131 so that they can engage the elongated member. Each of the first and second projections 151, 152 comprise a gripping surface 153, 154 which is adapted to engage a major surface of the elongated member to provide friction between the resilient element 150 and the elongated member. The retaining element 180 extends between the first and second projections 151, 152 so that the resilient element 150 is securely retained in the cavity 140. The edges of the gripping surfaces 153, 154 in the longitudinal direction are preferably rounded as shown in FIG. 4. The gripping surfaces 153, 154 will thereby comprise rounded portions 155, 156 which reduce wear on the resilient element 150 when the elongated member is forced to move by the user.

Figure 3:
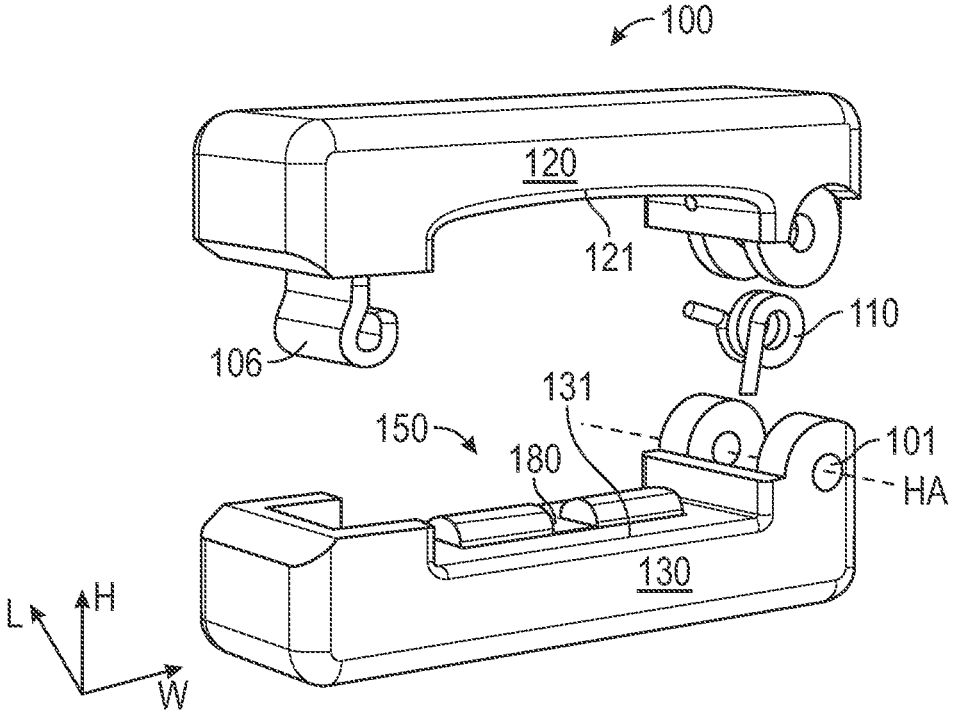
FIG. 3 shows a perspective and partly exploded view of the jewelry clip of FIG. 1.

FIG. 3 shows a perspective view of the jewelry clip 100 described above. As can be seen, the retaining element 180 extends over the entire length of the resilient element 150, thus preventing the resilient element 150 from coming out of the cavity 140 unintentionally. To achieve this configuration, the retaining element 180 is either attached to the second part 130 after insertion of the resilient element 150 into the cavity, or attached before and bended upwards so that the resilient element 150 can be inserted into the cavity after which the retaining element 180 can be bend down in the correct position and optionally welded/soldered to ensure a solid attachment.

When the jewelry clip is clipped onto the elongated member, the resilient element may be compressed. This compression of the resilient element provides a force which urges the jewelry clip to open. The force provided by the spring biasing the jewelry clip toward the closed state counteracts this force and thus provides a more secure clip. Similarly, when the jewelry clip is attached on, and compresses, a resilient elongated member, a force urging the jewelry clip to open also occurs. In such situations the force urging the jewelry clip to open exerted by the compression of the resilient element and the compression of the resilient elongated member may compound, making the counteracting force biasing the jewelry clip toward the closed state provided by the spring even more important.

FIG. 4 shows the resilient element 150 by itself from a perspective view. The resilient element 150 comprises two anchor portions 159 which extend outwards in the width direction (W), the anchor portions 159 being adapted to fit in under the overhanging side walls 143 of the cavity 140. Furthermore, the resilient element 150 has a groove 158 between the first and second projections 151, 152, the groove 158 being formed to accommodate the retaining element 180, thereby limiting the freedom of movement for the resilient element 150 once inserted into the cavity 140 and retained by the retaining element 180.

Figure 5:
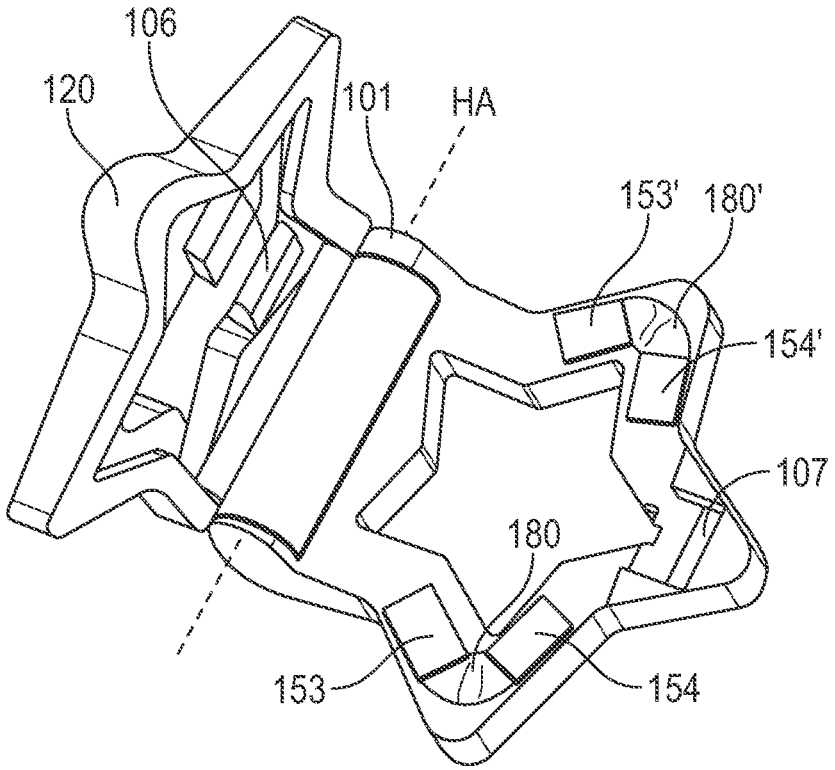
FIG. 5 shows a top view of a jewelry clip in the open state.
Figure 6:
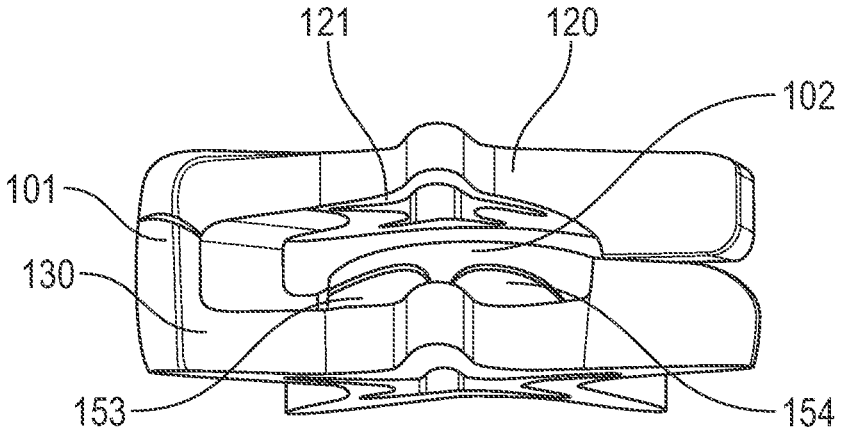
FIG. 6 shows a side view of the jewelry clip of FIG. 5 in the closed state.

Turning now to FIGS. 5 and 6, another embodiment of a jewelry clip 100 is shown in the open and in the closed state, respectively. The shown embodiment is largely identical to the embodiment shown in FIGS. 1 to 3, but differs in the following.

The shown clip 100 has an outer shape like that of a star to provide an aesthetic appearance. This shape means that the length of the through hole 102, i.e. in the longitudinal direction (L), is comparable to the width of the through hole 102, i.e. in the width direction (W). To provide sufficient friction for such a jewelry clip 100 to remain at the selected location on an elongated element, the jewelry clip 100 could be provided with a longer resilient element 150.

Figure 7A:
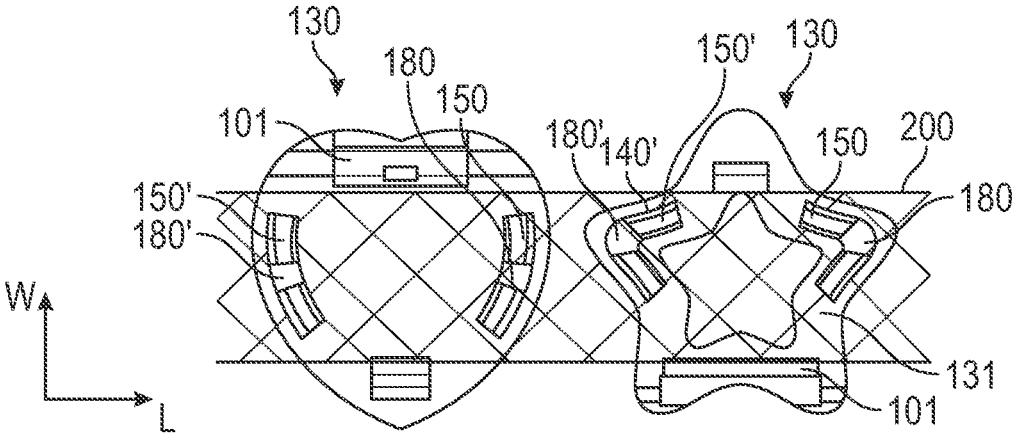
FIG. 7*a-c* show a top view of a second part of various embodiments of a jewelry clip.

Instead, as seen in FIG. 7*a*, the shown embodiment comprises a second resilient element 150' arranged in another cavity 140' in the second surface 131. The second retaining element 150' is substantially identical to the first retaining element 150 described in the previous embodiment. The first and second retaining elements 150, 150' are arranged proximate to respective ones of the first and second openings, so that the friction between the gripping surfaces of the retaining elements 150, 150' and the elongated member is even throughout the length of the through hole, and so that the elongated member is gripped more securely near the first and second openings 115, 116.

The following will describe a method for assembling a necklace or bracelet by clipping a jewelry clip 100 as seen in FIGS. 1-3 onto an elongated member for a necklace or bracelet.

The jewelry clip 100 is brought into an open state by overcoming a force that biases the jewelry clip 100 toward a closed state by rotating the first and the second clip parts 120, 130 about a hinge axis HA of a hinge 101 connecting the first and second parts 120, 130, where the biasing force is provided by a discrete spring 110.

Subsequently, the jewelry clip 100 is then brought from the open state into the closed state, thereby enclosing the elongated member such that the elongated member is positioned in the through hole 102 of the jewelry clip 100 where the jewelry clip 100 grips the elongated member.

This provides an easy to assemble necklace or bracelet, which allows beads or other ornamental components on the necklace or bracelet to be organized as described herein, without the need for any tools or other special utensils.

Figure 7B:
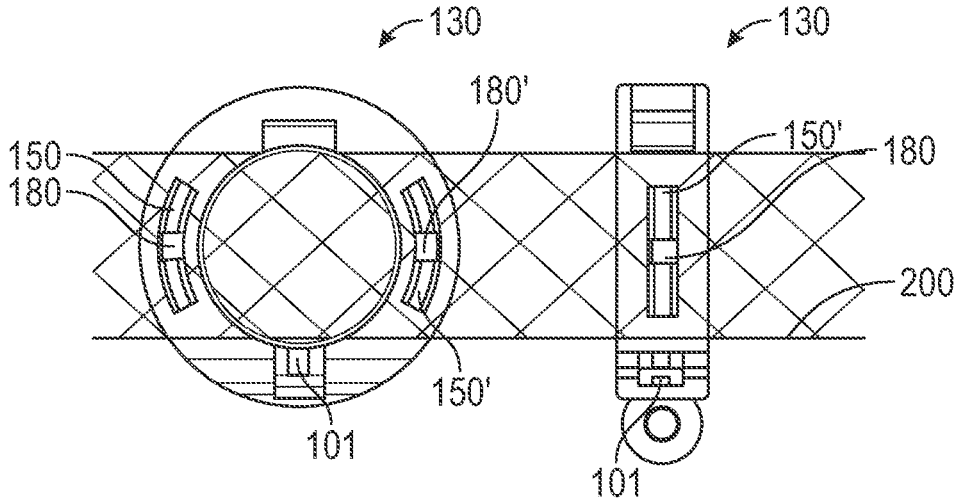
Figure 7C:
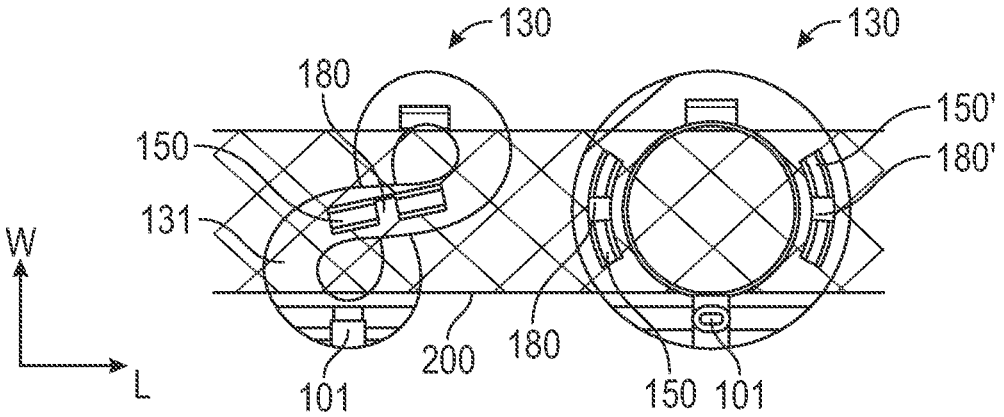

Turning now to FIGS. 7*a-c*, the second part 130 of various embodiments of the jewelry clip 100 is shown from a top view. The first parts 120 of the shown embodiments may be provided with resilient elements 150 similarly to the second parts 130. Alternatively, only the first parts 120 may be provided with one or more resilient elements 150. In FIGS. 7*a-c*, an elongated member 200 is shown.

Figure 8:
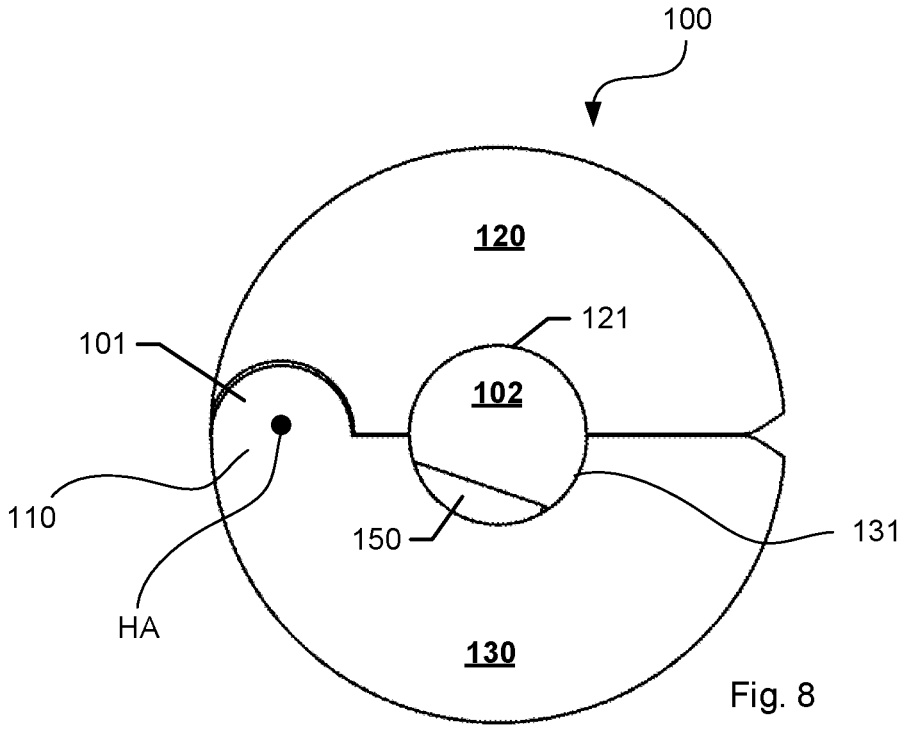
FIG. 8 shows a schematic side view of a jewelry clip with a round outer shape, in the closed state.
Figure 9:
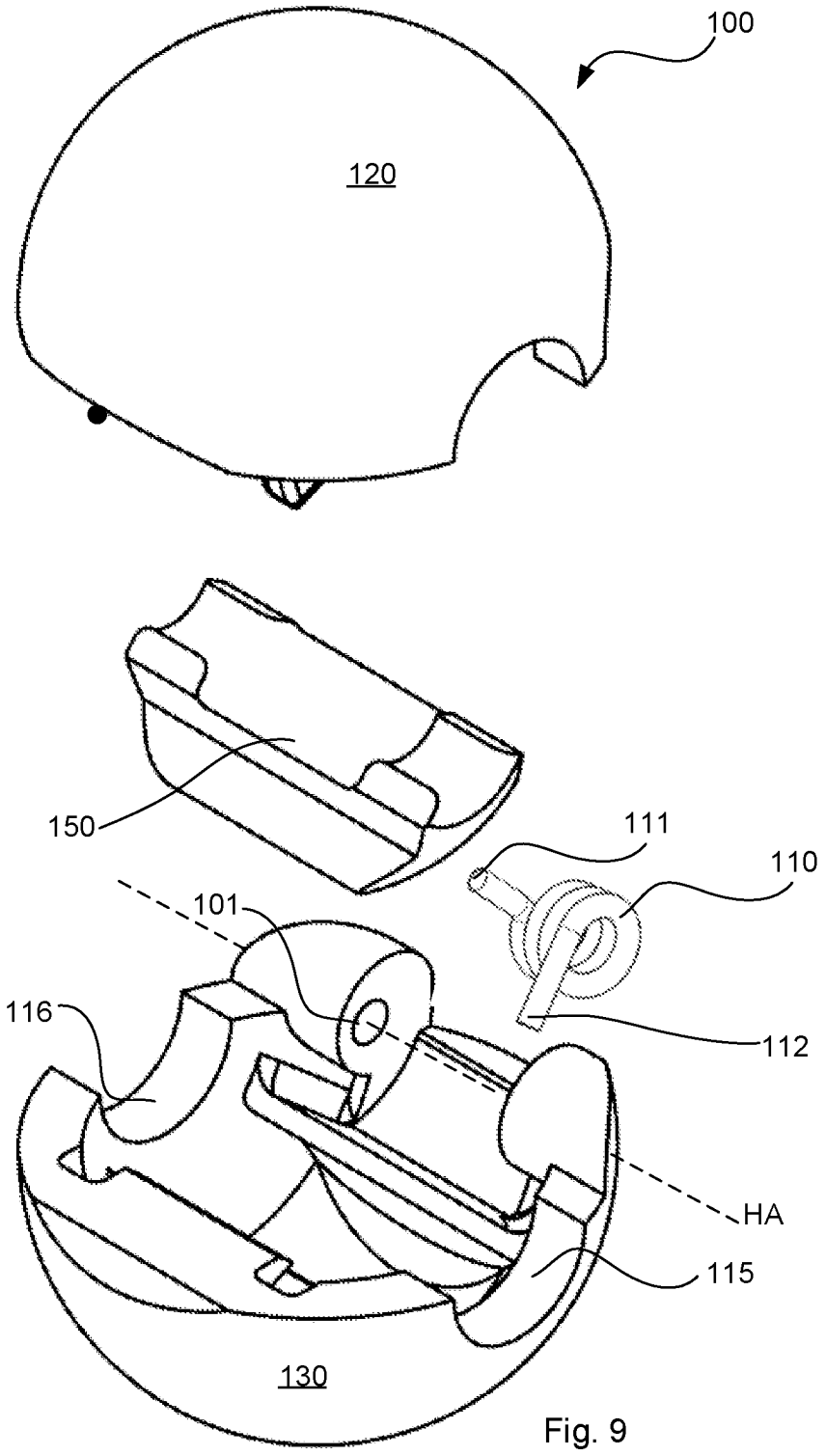
FIG. 9 shows a perspective and partly exploded view of the jewelry clip of FIG. 8.

FIGS. 8 and 9, show a jewelry clip 100 with a circular outer shape and a substantially circular cross-sectional shape in the longitudinal direction. A first end 111 of the discrete spring 110 here abuts the first part of the jewelry clip 120 and the second end 112 of the discrete spring 110 abuts the second clip part 130. In this way the discrete spring 110 biases the two clip parts 120, 130 toward a closed state of the jewelry clip 100.

Figure 10:
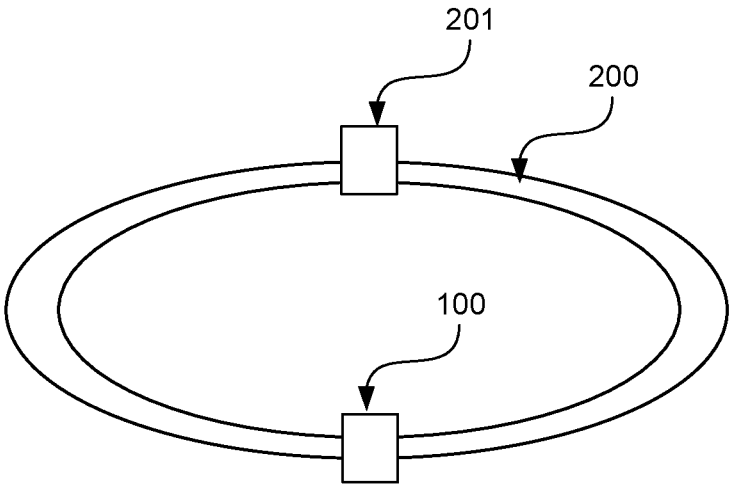
FIG. 10 shows an assembled set of parts including a jewelry clip according to FIG. 9 and an elongated member.

FIG. 10 shows schematically an assembled set of parts including a jewelry clip 100 according to FIG. 9 which is clipped onto an elongated member 200 similar to that of FIGS. 7*a-c*. The elongated member 200 is a braided wire or string having a substantially circular cross section. The elongated member 200 includes two ends that are assembled by a bracelet lock 201 in a conventional manner. The set of parts may include one, two or more further jewelry clips of similar structure as the jewelry clip 100, potentially with varying ornamentation according to a user's desires.

The invention claimed is:

1. A jewelry clip for being clipped onto an elongated member of a bracelet and/or necklace, the jewelry clip comprising:

a first part having proximal and distal ends and a second part having proximal and distal ends, an extremity of the proximal end of the first part and an extremity of the proximal end of the second part collectively defining a terminal wall, the second part being connected to the first part by a hinge having a hinge axis, at least one of an extremity of the distal end of the first part and an extremity of the distal end of the second part being beveled where the first part meets the second part thereby forming a recess, the first and second parts being moveable between an open state and a closed state by rotation about the hinge axis, wherein the jewelry clip in the closed state is adapted for gripping the elongated member and in the open state is adapted for being released from the elongated member; and at least one discrete compression or torsion spring, the spring biasing the jewelry clip toward the closed state when the jewelry clip is in the open state;

wherein the jewelry clip has, in the closed state, a through hole extending in a longitudinal direction between a first and a second opening so that the elongated member can be positioned to extend through the through hole;

wherein at least one of the first and second parts includes at least one resilient element positioned to form part of the at least one of the first and second parts so that the resilient element defines at least part of an inner surface of the jewelry clip defining the through hole in the closed state of the jewelry clip;

whereby, when the jewelry clip is clipped onto the elongated member, the resilient element provides a frictional resistance against movement of the elongated member through the through hole; and wherein the jewelry clip is configured to be positionally fixed by the frictional resistance of the resilient element on the elongated member when clipped onto the elongated member, and to be moved along the elongated member by providing a force that overcomes the frictional resistance.

2. The jewelry clip of claim 1, wherein the discrete spring biases the jewelry clip toward the closed state anywhere between a fully open state and the closed state.

3. The jewelry clip of claim 1, wherein at least one of the at least one resilient element is configured to be compressed when the jewelry clip is in the closed state and clipped onto the elongated member.

4. The jewelry clip of claim 1, wherein the jewelry clip in the closed state is locked by a snap lock.

5. The jewelry clip of claim 1, wherein the discrete spring comprises a first end and a second end, wherein the first end is in physical contact with the first clip part and the second end is in physical contact with the second clip part, to thereby bias the jewelry clip toward the closed state.

6. The jewelry clip of claim 1, wherein the discrete spring is located at the hinge axis.

7. The jewelry clip of claim 1, wherein the discrete spring is positioned concentrically with the hinge axis.

8. A set of parts for being assembled to form a bracelet or necklace, comprising:

an elongated member for a bracelet or a necklace; and the jewelry clip of claim 1.

9. A method of assembling the set of parts of claim 8 to form a necklace or bracelet by clipping a jewelry clip onto an elongated member, the method comprising clipping the jewelry clip onto the elongated member.

10. The jewelry clip of claim 1, wherein an external perimeter of the first part is the same as an external perimeter of the second part.

11. The jewelry clip of claim 10, wherein:

at least one of the first and second parts has a cavity spanned by a retaining element; and the at least one resilient element has first and second projections with a groove therebetween, the retaining element being located in the groove, the first and second projections extending into the through hole.

12. The jewelry clip of claim 1, wherein:

at least one of the first and second parts has a cavity spanned by a retaining element; and the at least one resilient element has first and second projections with a groove therebetween, the retaining element being located in the groove, the first and second projections extending into the through hole.

13. The jewelry clip of claim 1, wherein:

the first and second parts define a cavity;

the spring is located in the cavity; and the spring is enclosed when the first and second parts are at the closed state.

14. A jewelry clip for being clipped onto an elongated member of a bracelet and/or necklace, the jewelry clip comprising:

a first part having proximal and distal ends and a second part having proximal and distal ends, the second part being connected to the first part by a hinge having a hinge axis, at least one of an extremity of the distal end of the first part and an extremity of the distal end of the second part forming a gap where the first part meets the second part, the first and second parts being moveable between an open state and a closed state by through rotation about the hinge axis by imparting a force at a location between the hinge axis and the distal ends of the first and second parts, wherein the jewelry clip in the closed state is adapted for gripping the elongated member and in the open state is adapted for being released from the elongated member; and at least one discrete compression or torsion spring, the spring biasing the jewelry clip toward the closed state when the jewelry clip is in the open state;

wherein the jewelry clip has, in the closed state, a through hole extending in a longitudinal direction between a first and a second opening so that the elongated member can be positioned to extend through the through hole;

wherein at least one of the first and second parts includes at least one resilient element positioned to form part of the at least one of the first and second parts so that the resilient element defines at least part of an inner surface of the jewelry clip defining the through hole in the closed state of the jewelry clip;

whereby, when the jewelry clip is clipped onto the elongated member, the resilient element provides a frictional resistance against movement of the elongated member through the through hole; and wherein the jewelry clip is configured to be positionally fixed by the frictional resistance of the resilient element on the elongated member when clipped onto the elongated member, and to be moved along the elongated member by providing a force that overcomes the frictional resistance.

15. The jewelry clip of claim 14, wherein an external perimeter of the first part is the same as an external perimeter of the second part.

16. The jewelry clip of claim 14, wherein:

at least one of the first and second parts has a cavity spanned by a retaining element; and the at least one resilient element has first and second projections with a groove therebetween, the retaining element being located in the groove, the first and second projections extending into the through hole.

17. The jewelry clip of claim 14, wherein:

the first and second parts define a cavity;

the spring is located in the cavity; and the spring is enclosed when the first and second parts are at the closed state.

18. The jewelry clip of claim 14, wherein the proximal end of the first part and the proximal end of the second part collectively define a terminal wall such that the terminal wall is located at an extremity of the proximal end of the first part and an extremity of the proximal end of the second part.

19. The jewelry clip of claim 14, wherein at least one of the extremity of the distal end of the first part and the extremity of the distal end of the second part is beveled where the first part meets the second part to form the gap.

* * * * *